US009227391B2

(12) United States Patent
Baggen et al.

(10) Patent No.: US 9,227,391 B2
(45) Date of Patent: Jan. 5, 2016

(54) DUAL FUNCTION SHOE UPPER PRINTING JIG

(71) Applicant: NIKE, INC., Beaverton, OR (US)

(72) Inventors: Jared S. Baggen, Portland, OR (US); Melody Crisp, Beaverton, OR (US); Ito Jahja, Beaverton, OR (US); Henry M. Ortega, Portland, OR (US); Christopher Vacca, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 79 days.

(21) Appl. No.: 14/158,145

(22) Filed: Jan. 17, 2014

(65) Prior Publication Data

US 2015/0202861 A1 Jul. 23, 2015

(51) Int. Cl.

| | |
|---|---|
| ***B41F 17/16*** | (2006.01) |
| ***B41F 17/18*** | (2006.01) |
| ***B41F 17/38*** | (2006.01) |
| ***B41F 15/34*** | (2006.01) |
| ***A43D 8/22*** | (2006.01) |
| ***B41F 17/00*** | (2006.01) |
| ***B41F 17/34*** | (2006.01) |
| ***B41J 3/407*** | (2006.01) |

(52) U.S. Cl.

CPC . *B41F 15/34* (2013.01); *A43D 8/22* (2013.01); *B41F 17/001* (2013.01); *B41F 17/005* (2013.01); *B41F 17/34* (2013.01); *B41F 17/38* (2013.01); *B41J 3/4073* (2013.01)

(58) Field of Classification Search

CPC ..... B41F 17/001; B41F 17/006; B41F 17/08; B41F 17/14; B41F 17/16; B41F 17/18; B41F 17/28; B41F 17/30; B41F 17/34; B41F 17/36; A43D 8/22; A43D 8/00

See application file for complete search history.

(56) References Cited

U.S. PATENT DOCUMENTS

| | | | | |
|---|---|---|---|---|
| 4,450,130 | A * | 5/1984 | Doerer | 264/154 |
| 4,698,001 | A * | 10/1987 | Vismara | 425/4 R |
| 4,873,049 | A * | 10/1989 | Landwehr et al. | 264/513 |

(Continued)

FOREIGN PATENT DOCUMENTS

| | | | |
|---|---|---|---|
| GB | 2315242 | A | 1/1998 |
| WO | 2010037039 | A1 | 4/2010 |

OTHER PUBLICATIONS

International Search Report with Written Opinion dated May 6, 2015 in Application No. PCT/US2015/012071, 11 pages.

*Primary Examiner* — David Banh

(74) *Attorney, Agent, or Firm* — Shook, Hardy & Bacon L.L.P.

(57) ABSTRACT

A printing jig system that includes a maintaining jig able to maintain an article for a first processing step and that is also used to maintain and align the article for a subsequent printing process step. In order to effectively be used for a first processing step and a second printing process step, a support portion supports the article in locations otherwise left unsupported by a processing aperture of the maintaining jig. The processing aperture is configured to facilitate the first processing step, such as steaming of the article. The print support portion is configured to extend through the processing aperture of the maintaining jig The maintaining jig and the print support portion are aligned and maintained relative to each other and a printing machine by a base plate adapted to removeably secure and align the maintaining jig and the print support portion.

17 Claims, 6 Drawing Sheets

(56) References Cited

U.S. PATENT DOCUMENTS

| | | | | |
|---|---|---|---|---|
| 5,297,480 | A * | 3/1994 | Miyashita et al. | 100/90 |
| 5,551,860 | A * | 9/1996 | Budzynski et al. | 425/504 |
| 5,575,206 | A * | 11/1996 | Szyszko | 101/126 |
| 7,765,927 | B1 | 8/2010 | Liu et al. | |
| 7,980,177 | B2 * | 7/2011 | Styles et al. | 101/483 |
| 8,393,605 | B2 * | 3/2013 | Yang et al. | 269/287 |
| 2010/0206194 | A1 | 8/2010 | Lehner et al. | |
| 2010/0269271 | A1 * | 10/2010 | Kim et al. | 12/146 B |
| 2012/0175813 | A1 | 7/2012 | Leedy | |
| 2012/0272463 | A1 * | 11/2012 | Crisp et al. | 12/103 |
| 2013/0014330 | A1 * | 1/2013 | Romero et al. | 12/123 |
| 2013/0017330 | A1 * | 1/2013 | Padilla | 427/256 |

* cited by examiner

DUAL FUNCTION SHOE UPPER PRINTING JIG

CROSS-REFERENCE TO RELATED APPLICATIONS

Not applicable.

TECHNICAL FIELD

Manufacturing of an article may include printing on the article in a repeatable, accurate, and efficient manner using a printing jig.

BACKGROUND

Printing on a surface of an article can be difficult when the surface is irregular or has dimensional variations. Some of the variation in the surface may be a product of the manufacturing process used to form the article. For example, when knitting or weaving an article, different tensions may exists at different locations of the article causing one or more dimensional variations, such as puckering or creases. Steam or other processes applied to the dimensional irregularity may be effective for limiting the surface irregularity. Therefore, it may be advantageous to process, such as apply steam, an article in at least a portion that is intended to receive printed indicia. However, transferring and separately aligning the article from a first operation, such as steaming, to a second operation, such as printing, can increase manufacturing time and costs as the article is realigned at each of the processing steps.

BRIEF SUMMARY

Aspects relate to a printing jig system that includes a maintaining jig that is able to maintain an article for a first processing step and also used to maintain and align the article for a subsequent printing process step. In order to effectively be used for a first processing step and a second printing process step, aspect hereof comprise a print support portion that supports the article in locations otherwise left unsupported by a processing aperture of the maintaining jig. The processing aperture is configured to facilitate the first processing step, such as steaming of the article. The print support portion is configured to extend through the processing aperture of the maintaining jig to provide resistive support to a compressive force exerted on the article by a pad printing machine. The support provided by the support portion limits the deformation and experienced by the printing operation and improves the pad printing result, in exemplary aspects hereof. The maintaining jig and the print support portion are aligned and maintained relative to each other and a printing machine, in an exemplary aspect, by a base plate adapted to removeably secure and align the maintaining jig and the print support portion.

BRIEF DESCRIPTION OF THE DRAWINGS

The present invention is described in detail herein with reference to the attached drawing figures, wherein.

DETAILED DESCRIPTION

Figure 1:
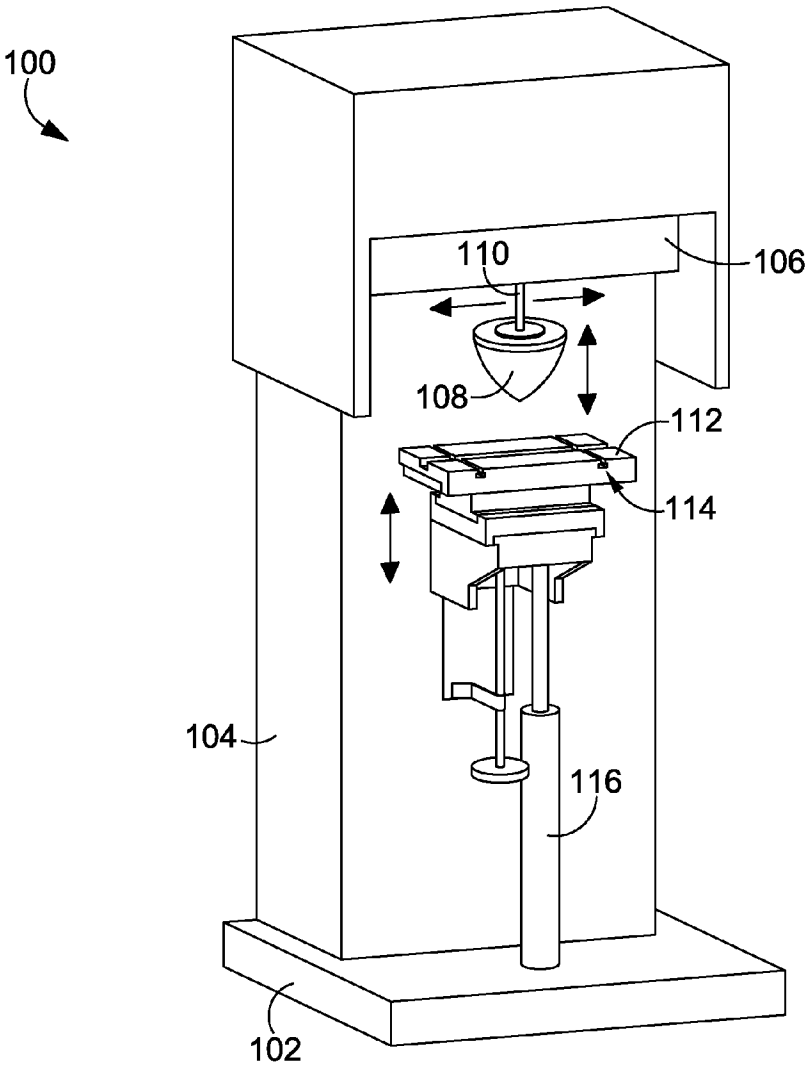
FIG. 1 depicts an exemplary pad printing machine in accordance with an aspect hereof.

Aspects hereof provide a printing jig system comprised of a base plate, a print support portion, and a maintaining jig. The base plate having a top surface and an opposite bottom surface, a front side and an opposite back side, a first side and an opposite second side. The base plate also having a plurality of protrusions extending outwardly from the top surface and a plurality of receiving portions extending from the top surface toward the bottom surface. The printing jig system also including the article maintaining jig having a top surface and an opposite bottom surface, a front side and an opposite back side, a first side and an opposite second side. The maintaining jig having a plurality of maintainers extending outwardly from the top surface; a plurality of alignment receptors configured to receive the plurality of protrusions of the base plate such that the bottom surface of the maintaining jig is positionable proximate the top surface of the base plate; and a processing aperture extending from the top surface through the article maintaining jig to the bottom surface. The printing jig system also including the print support portion comprised of a top surface and an opposite bottom surface. The print support portion includes one or more alignment pins extending outwardly from the bottom surface and adapted to be received in the base plate receiving portions. The print support portion having a shape adapted to pass through the processing aperture of the article maintaining jig.

Another aspect provided herein is directed to a method of using the jig printing system. The method includes positioning a print support portion in a base plate. Additionally, an article is secured onto a first article maintaining jig. The article extends over a processing aperture of the first article maintaining jig. The method also includes positioning the first article maintaining jig on the base plate such that the print support portion extends through at least a portion of the first article maintaining jig. The method may also include printing on the article in a location proximate the print support portion that is supporting the.

Printing on to an article allows for the depositing of a substance, such as a marking agent, that may change a characteristic of the article. The characteristics may be functional, aesthetic, or both in nature. Traditionally, printing may be used to apply an ink to the surface of an article to enhance or change a visual appearance of at least a portion of the article. Printing may be accomplished using a variety of techniques, such as spraying, rolling, stamping, transferring, and the like. Different printing techniques provide different advantages. Pad printing, also referred to tampography, is a technique for depositing an agent, such as a marking agent, onto a surface of an article through a transfer of the agent in a specified configuration by a pad. The pad having the agent applied in a specific configuration is then placed, with pressure, on the surface of the article to be printed. It is contemplated that the pad may be repeatedly positioned on the article in a common location to ensure a sufficient transfer of the agent onto the article surface.

Pad printing uses several elements to effectively transfer ink from a cliché (i.e., an etched plate having ink stored thereon in a specific configuration for transfer to the article) to the article by way of a pad. The cliché is an image plate having a desired design or configuration etched to a surface. The cliché may be formed from a metal, such as aluminum or steel, or the cliché may be formed from a polymer, such as a photosensitive polymer. Further, it is contemplated that the cliché may be formed from a composite of a base layer of a metallic material (e.g., aluminum) that is laminated to a top layer of a photosensitive polymer. This composite achieves benefits of durability and stiffness provided by the base layer and the ease of etching provided by the top layer. The etching on the surface of the cliché may be formed through an Ultraviolet Light exposure etching, laser etching, mechanical etching, and the like. The etching may extend into the cliché a depth of 25 to 65 microns, in an exemplary aspect. The etching may have a configuration similar to that of a logo or other indicia desired to be represented on the article.

The agent, such as ink, is deposited in the etching of the cliché in a number of ways. A first option for supplying ink includes an open inkwell system having an ink trough supplying ink for a flood bar that pushes ink over the etching with a doctor blade removing excess ink from the plate surface other than the etched portion. An alternative method of supplying ink to the etched portions of the cliché includes a sealed ink cup system. In the sealed ink cup system, a sealed ink cup serves as the ink supply. A ceramic ring is coupled with the ink cup to provide a seal between the ink cup and the cliché surface. It is the ceramic ring that serves the function of both a flood bar and a doctor blade as the ring supplies, in part, pressure to apply ink to the etched surface while also wiping excess ink from the cliché surface. The ink cup is further contemplated to comprise a magnet that may be useable for adjusting an amount of pressure applied by the ink cup assembly to the cliché surface. While specific configurations and components are discussed with the ink cup, it is exemplary in nature not intended to be limiting to all aspects.

The ink deposited in the cliché etched pattern is transferred from the etching to the article by a pad. The pad is a three-dimensional shape formed from a material that may deform under pressure, such as silicone rubber. The durometer of the pad may vary depending on the article or substrate on to which the printing will occur. For example, when the pad is formed from a silicone rubber, an amount of oil used in the production of the pad can vary the softness of the pad, such that the more oil introduced to the silicone during the forming of the pad, the softer the pad results. It is also contemplated that a pad may be formed having multiple durometers to effectively print onto a varied substrate/article. It is further contemplated that the pad may be comprised of a base portion that provides a coupling surface and/or a uniform force distribution surface. This base portion may be formed from metal, wood, or polymer-based materials, for example. It is further contemplated that the pad may also be comprised of a deformation portion that is formed from a deformable material intended to deform upon contact with the article, in an exemplary aspect.

The configuration of a pad for use in the pad printing process may have any shape suitable for a desired implementation. It is contemplated that a round (e.g., hemispherical) pad having a conical tip may be used. For uneven surfaces on an article, such as a knit surface, an angular faceted pad may be used having apex of two or more facets forming a leading edge is contemplated. The pad may have a variety of hardness measures, such as a hardness between 2 and 18 Shore A hardness, in an exemplary aspect.

Pad printing is traditionally accomplished by placing the ceramic ring portion of the ink cup assembly on the etched surface of the cliché so that ink flows from the ink cup assembly and fills the etched design of the cliché. As the ink cup assembly is slid along the surface of the cliché to expose the etched design, the ceramic ring removes excess ink from the cliché surface other than in the etched portion. The remaining ink filling the etched portion is then transferred to a surface of a pad that is depressed on to the surface of the cliché over the etched design. The compressed pad deforms and evacuates air between the pad and the ink maintained in the etching. As the air is evacuated and the pad contacts the ink maintained in the etching, the ink transfers to the surface of the pad in the configuration of the etching. The pad is then positioned over the article to be printed and the pad is compressed, sometimes repeatedly, on to the surface of the article. The contact between the pad and the article surface transfers the ink from the pad surface to the article surface in the configuration defined by the etching.

The article to be printed, a substrate, may be any article. In an exemplary aspect, the article is a knit or woven portion of an article of footwear, such as a shoe upper. While the following will reference a shoe upper, it is understood that the methods and articles discussed herein may be applied to any substrate and the reference to a shoe upper is for convenience.

In an exemplary aspect, it is contemplated that the article to be printed is a shoe upper or a portion of a shoe upper. Further, it is contemplated that the shoe upper (or portion) may be formed from a knitting or weaving operation that results in an integrally formed article portion. As will be discussed hereinafter, one or more post production steps may be applied to the shoe upper. For example, the shoe upper may be steamed in one or more portions to relax the yarns used to form the shoe upper, to alter characteristics of the shoe upper (e.g., fuse fusable materials, activate activatable materials), or otherwise prepare the article for printing. Steaming of a portion of the shoe upper may also cause portions of the shoe upper to smooth out and provide a more suitable surface on to which a printing operation may be performed. For example, a shoe upper that is knit having a variety of yarns dropped in and out during production with different tensions intentionally or unintentionally applied during the knitting process may result in a knit shoe upper having irregularities caused by the uneven tensioning throughout the shoe upper. The irregularities may cause surface dimensional variability that interferes with providing a consistent and aesthetically desired print result. Therefore, steam may be applied (or other suitable forms of heat) to relax one or more yarns causing a reduction in surface dimensional variability in a region to be printed to provide a more uniformly dimensioned surface to achieve a desired printing result.

The steaming process in connection with selectively applied tension in an X-Y plane helps reduce a surface dimensionality in the Z direction. The selectively applied tension in the X-Y plane may be achieved using a jig, such as a jig depicted in FIGS. 3-6B hereinafter. As will be discussed, a jig may provide a number of maintainers, such as pins protruding from a surface of the jig. The maintainers are effective for maintaining the article in a fixed position relative to the jig. The jig may also be comprised of a processing aperture that allows a process to be performed on the article, such as a steam treatment. Therefore, it is contemplated that a plurality of maintainers extending from a jig surface are effective to maintain and apply a desired amount of tension across and X-Y plane of the article. The processing apertures are positioned on the jig to allow for a processing of the article, such as steaming, to be performed in specific location, such as areas intended to have a printing process performed.

As will be described hereinafter, the jig, while effective for maintaining and steaming of the article, may not alone be suitable for performing a printing operation. For example, the processing aperture may be an absence of material from the jig in a very location that pad printing requires a uniform support surface to effective resist the pressure exerted on the article as the pad is compressing on the article to transfer the marking agent. As such, additional components may be used in connection with a jig to support the process of pad printing while providing consistent alignment and improved manufacturability efficiencies.

Referring now to FIG. 1, an exemplary pad printing machine 100 is depicted in accordance with aspects hereof. The pad printing machine 100 is an exemplary structure effective for tampography. However, it is contemplated that any pad printing device having any configuration and any componentry may be used to accomplish aspects provided herein. For example, it is contemplated that while the pad printing machine 100 is depicted as having a single pad and bench for performing a pad printing process, a single machine may be comprised of multiple pads and one or more benches to concurrently or independently perform pad printing steps on multiple articles or using multiple marking agents, in an exemplary aspect. Therefore, while a specific pad printing mechanisms is depicted in FIG. 1 for explanation purposes, it is contemplated that alternative configurations may be implemented to achieve results provided herein.

The pad printing machine 100 is comprised of a supporting structure that includes a base structure 102 and a vertical support structure 104. The base structure 102 may be a footprint portion that provides stability and resistance to movement of the pad printing device, which may be accomplished by one or more anchors into a supporting surface, such as a floor. The vertical support structure 104 extends upwardly from the base structure 102 to achieve sufficient vertical height for an operator to effectively manage and use the pad printing machine 100.

The pad printing machine 100 is further comprised of a rail slide 106. The rail slide 106 is a movement member traversing in a laterally direction across the pad printing machine 100 to effectively move a pad 108 in a linear direction, as depicted by the lateral arrows extending outwardly from a pad actuator member 110. The lateral movement provided, in part, by the rail slide 106 allows movement of the pad 108 and the pad actuator member 110 to be positioned at a particular location relative to an article on to which the pad will deposit a marking agent. Further, it is contemplated that the lateral movement afforded by the rail slide 106 may be used to position the pad 108 in a first position within a working range of the pad marking machine 100 to contact the cliché to uptake the marking agent in the configuration provided by the etched design. The pad 108 may then be laterally moved by the rail slide 106 to a position effective for depositing the marking agent on to an article maintained by a jig. Therefore, the lateral movement provided by the rail slide 106 may be used to access a cliché and ink source and then print the accessed ink onto an article maintained by a jig positioned within a working range of the pad printing machine 100, in an exemplary aspect. The cliché is not depicted in FIG. 1, but it is contemplated that it may be positioned within an operating region accessible by the pad 108, as is known in the art.

In addition to lateral movement, the pad 108 also moves in a vertical direction by way of the pad actuator member 110. The vertical movement of the pad 108 is useable to provide the compressive force of the pad 108 on to an article for transferring a marking agent from the pad to a surface of the article. Further, the vertical movement of the pad 108 by way of the pad actuator member 110 may allow the pad 108 to contact a cliché for accepting and transferring of ink from the cliché onto a surface of the pad 108. The pad actuator member 110 may move by any mechanical movement means, such as hydraulic, pneumatic, or linear motor movement, in exemplary aspects.

The pad printing device 100 is further comprised of a bench 112 that is vertically adjustable by a bench actuator 116. The bench 112 provides a work surface on to which one or more portions of a pad printing jig may be secured. In the illustrated exemplary configuration, the bench 112 is comprised of maintaining tracks 114. The maintaining tracks 114 allow for a removable coupling of one or more components, such as a base plate to be discussed hereinafter, to the bench 112 for use in facilitating the pad printing operation. The bench actuator 116 allows for the vertical movement of the bench 112 by any movement means contemplated herein such that the height of the bench 112 may be adjusted relative of a working region of the pad 108, in an exemplary aspect.

As provided above, it is contemplated that the pad printing machine may be comprised of additional or different components and is not limited to those exemplary components depicted and/or discussed herein. For example, it is contemplated that the pad printing machine 100 may be comprised of one or more control systems having a processor and memory. The control system may further comprise computer readable media having instructions embodied thereon for performing a method when executed by the processor. The method may be a method for printing on an article, a method for controlling the one or more actuators of the pad printing machine 100, and/or methods for controlling, in combination with other machines, the movement of one or more article in the pad printing process, for example.

Figure 2:
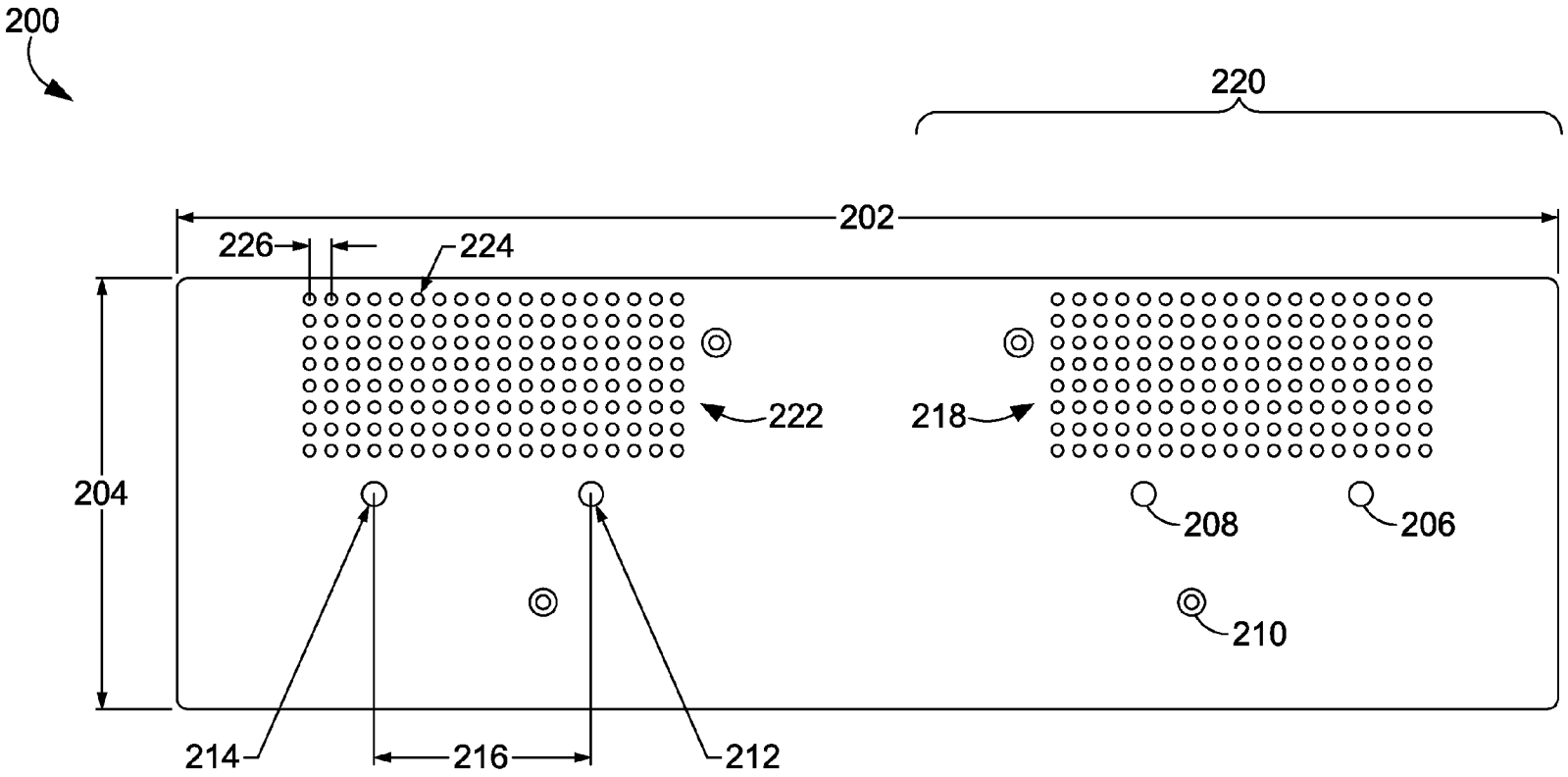
FIG. 2 depicts a base plate in accordance with an aspect hereof.

FIG. 2 depicts a base plate 200 in accordance with aspect hereof. The base plate 200 provides an alignment and securing components for an article maintaining jig and a print support portion, as will be discussed hereinafter. The base plate 200 may be secured to a pad printing machine, such as the bench 112 of the pad printing machine 100 of FIG. 1 discussed previously. For example, one or more fasteners, such as a fastener 210, may removeably couple the base plate 200 to the bench 112 through an interface of the maintaining track 114, in an exemplary aspect. While the fastener 210 is depicted in FIG. 2, it is contemplate that any fastening mechanism or technique may be implemented, such as mated components, clips, rails, welding, and other bonding techniques.

The base plate 200 has a width 202 and a length 204. The base plate 200 is defined by a front side and an opposite back side with each extending along the width 202. The base plate also having a first side and a second side with each extending along the length 204. Further, the base plate 200 is comprised of a top surface and a bottom surface, such that a maintaining jig may be secured proximate the top surface and the bench of a pad printing jig may be secured proximate the bottom surface. In an exemplary aspect, the width 202 is defined in a direction substantially parallel with a direction of linear movement offered by the rail slide 106 of FIG. 1. It is contemplated that the base plate 200 has a width 202 that is sufficient to secure one or more maintaining jigs, as will be illustrated hereinafter in FIG. 3. For example, a first portion 220 along the width 202 may be configured to wholly secure and align a maintaining jig and a support member relative to a pad printing machine. The first portion 220 may include less than half of the total width 202 such that a second portion of the base plate 200 is configured to secure and align a second maintaining jig that may also be positioned at the same pad printing machine. The base plate 200, therefore, may be used to secure and align multiple components for pad printing an article, which can improve cycle times and increase manufacturing efficiencies, in an exemplary aspect.

Figure 4:
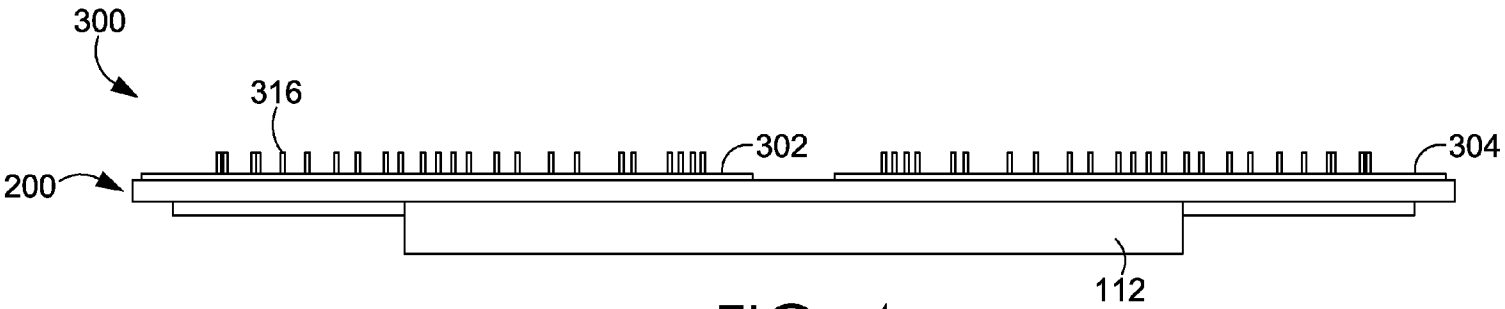
FIG. 4 depicts a front view of the jig assembly of FIG. 3 in accordance with an aspect hereof.
Figure 5:
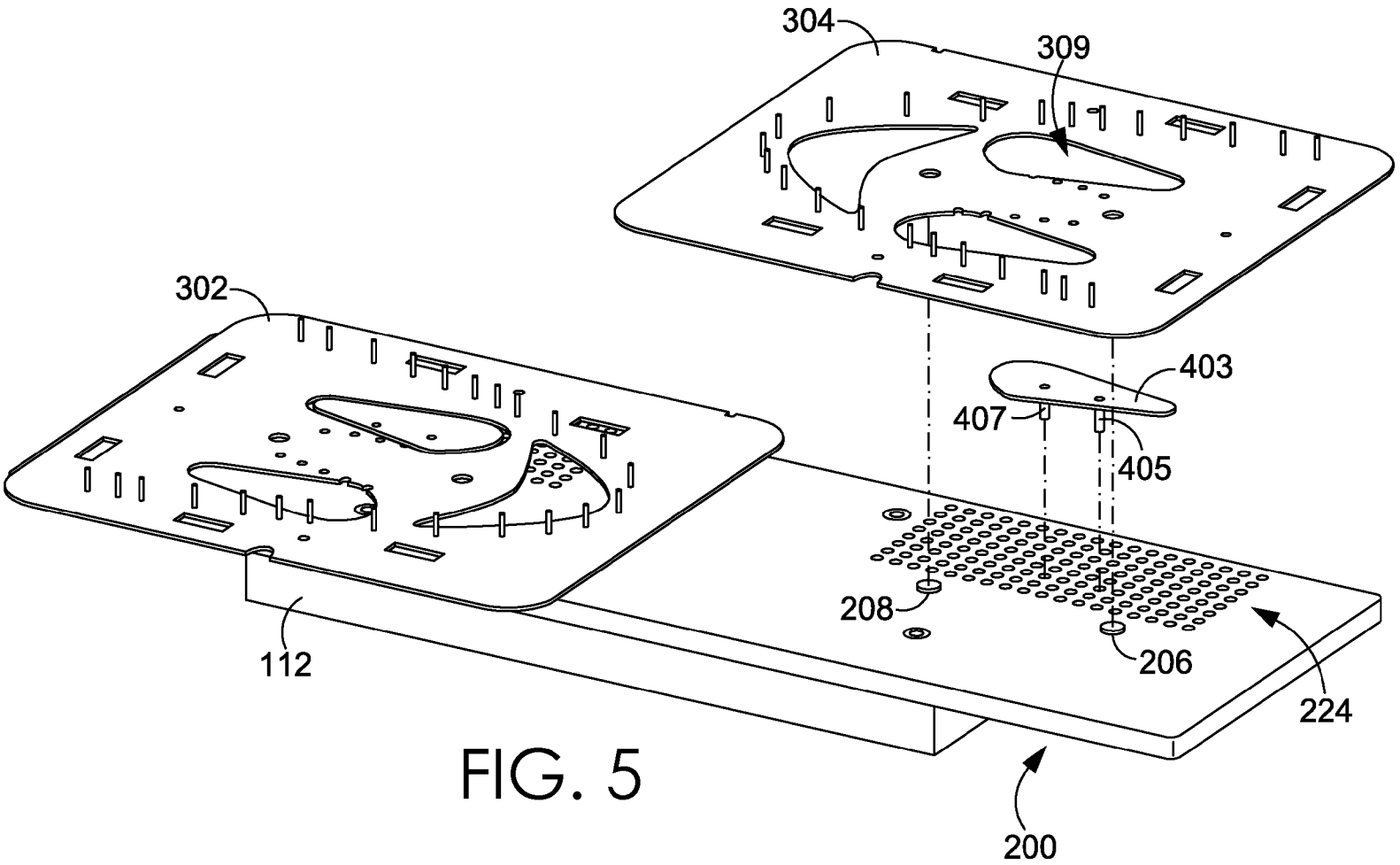
FIG. 5 depicts an exploded view of the jig assembly from FIGS. 3 and 4 in accordance with an aspect hereof.

Securing and aligning of a maintaining jig to the base plate 200, which will be illustrated hereinafter at FIG. 5, is accomplished with one or more alignment protrusions, such as alignment protrusion 206, 208 in the first portion 220. The alignment protrusions 206, 208 are depicted as a protrusion extending from the top surface and having a cross sectional shape in a plane parallel to the top surface that is circular. However, it is contemplated that the cross section may be of any shape and size in additional aspects hereof. Similarly, while the alignment protrusions 206, 208 are depicted as two different alignment protrusions, it is contemplated that any number of alignment protrusions may be implemented that are positioned in any configuration at any location on the base plate 200, in alternative aspects. A second portion of the base plate 200 is comprised of a second plurality of alignment protrusions 212, 214 that have a linear distance identified by line 216 extending there between. The distance 216 will be discussed with respect to the maintaining jig and the alignment receptors in particular hereinafter. Further, as will be discussed with respect to FIG. 4, the height to which an alignment protrusion extends from the top surface of the base plate 200 may be dependent on the thickness of a maintaining jig to be aligned. For example, in an exemplary aspect, the height of an alignment protrusion is approximately equal to a thickness of the maintaining jig such that the alignment protrusion does not protrude through the maintaining jig to interfere with one or more processes, such as pad printing, when the maintaining jig is secured with the base plate 220.

Each portion of the base plate 200, such as the first portion 220, is further comprised of a receiving portion grid, such as a grid 218. The receiving portions, such as a receiving portion 224 of a grid 222, are recesses configured to receive one or more extensions, such as pins, from a support portion. Stated differently, the receiving portions may be hole-like openings that are shaped to receive a particular member. The grid may be formed such that each of the receiving portions are spaced a particular distance, such as a distance identified by number 226 in the grid 222 of the second portion of the base plate 200. A receiving portion may extend all of the way from the top surface through the bottom surface of the plate 200, in an exemplary aspect. In an alternative aspect, the receiving portion may extend from the top surface to a defined depth into the base plate. This controlled depth of the receiving portion may be used in connection with a defined length of an alignment pin extending from a bottom surface of a support portion. As such, the defined length and depth allows for a support portion to extend a known height above the base plate 200 top surface, in an exemplary aspect. This known height may be used to selectively position a top surface of the support plate relative to a top surface of the maintaining jig.

The pluralities of receiving portions forming the grid are arranged in a grid-like manner. Each of the receiving portions is linearly aligned with other receiving portions in a common length-wise direction and a common width-wise direction, in an exemplary aspect. The spacing, such as spacing 226, may be maintained consistent in both the width-wise and the length-wise direction to a neighboring receiving portion. This grid consistency allows the base plate to serve as a universal base plate for a variety of maintaining jigs and a variety of support members of varied size and shape. Further, the grid being comprised of a plurality of receiving portions allows any combination of the receiving portions to be used to properly position and align a support member relative to a maintaining jig, in an exemplary aspect.

Figure 3:
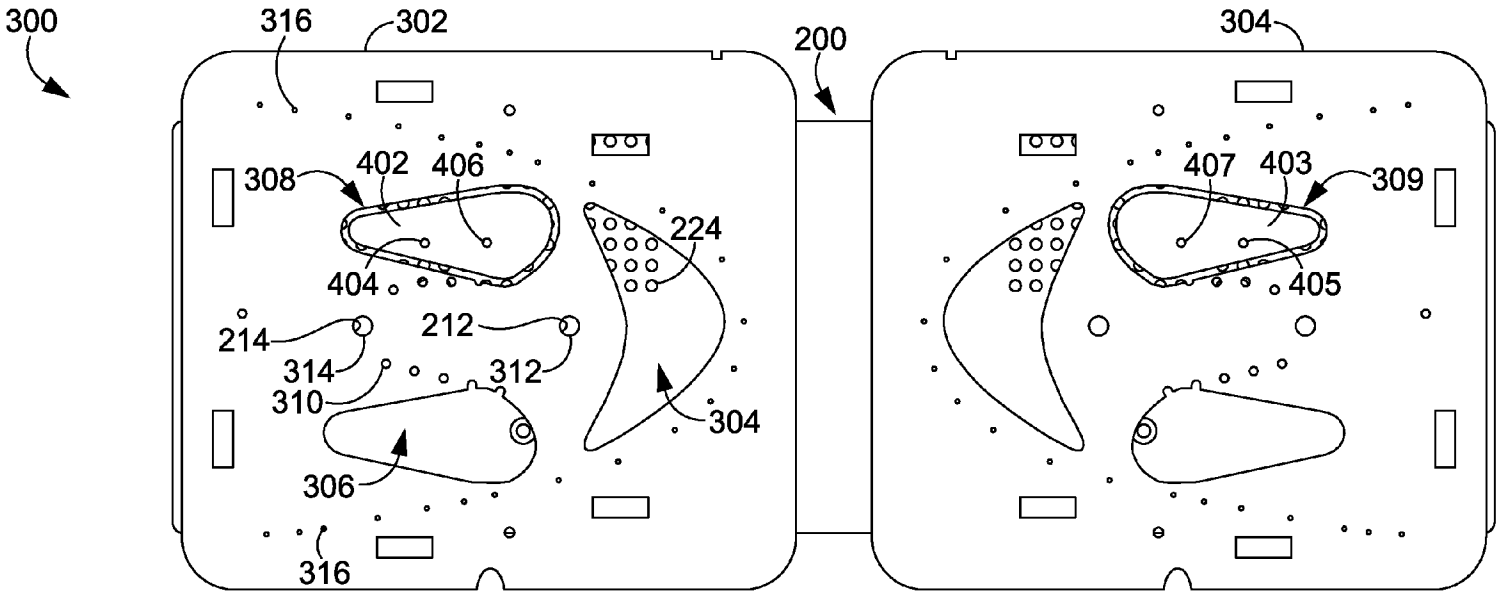
FIG. 3 depicts a top view of an exemplary printing jig assembly in accordance with an aspect hereof.

FIG. 3 depicts a top view of an exemplary printing jig assembly 300, in accordance with aspects hereof. The printing jig assembly 300 is comprised of the base plate 200 of FIG. 2, a first maintaining jig 302, a second maintaining jig 304, a first support member 402, and a second support member 403, in accordance with aspects hereof. While the jig assembly 300 is depicted as having multiple maintaining jigs and multiple supporting members, it is contemplated that any number of maintaining jigs and supporting members may form a printing jig assembly. For example, a base plate configured to receive one maintaining jig and one supporting member at a time is also contemplated within the scope hereof.

A maintaining jig, as previously discussed, is provided to secure and maintain an article to allow for the efficient processing of the article, such as through the application of heat or steam and the application of an agent through a printing process. As such, the first maintaining jig 302 is comprised of a plurality of processing apertures 304, 306, 308. The first maintaining jig 302 is further comprised of a plurality of maintainers 316 extending from a top surface. The first maintaining jig 302 is also comprised of a plurality of alignment receptors 312 and 314 extending from a bottom surface through the top surface of the first maintaining jig 302. While a specific configuration and number of components forming the first maintaining jig 302 are depicted and discussed, it is understood that any number or configuration of components may be implemented in exemplary aspects hereof. For example, a maintaining jig may have a single processing aperture of a different size and shape than that which is depicted in FIG. 3, while still accomplishing advantages provided herein.

Figure 6B:
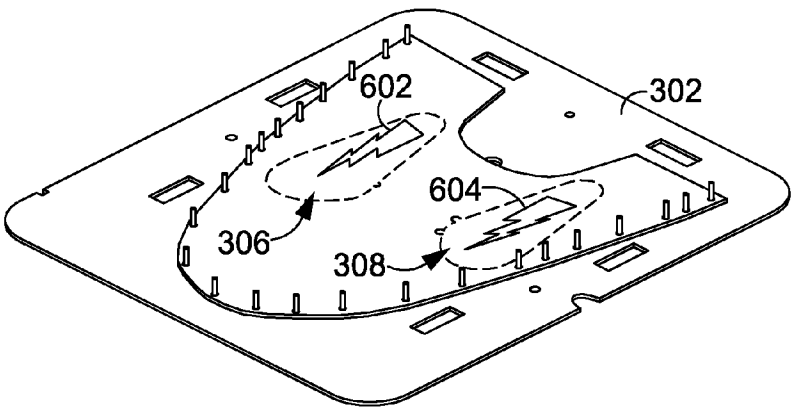
FIG. 6B depicts the article of FIG. 6A having a printed indicia in accordance with an aspect hereof.
Figure 6A:
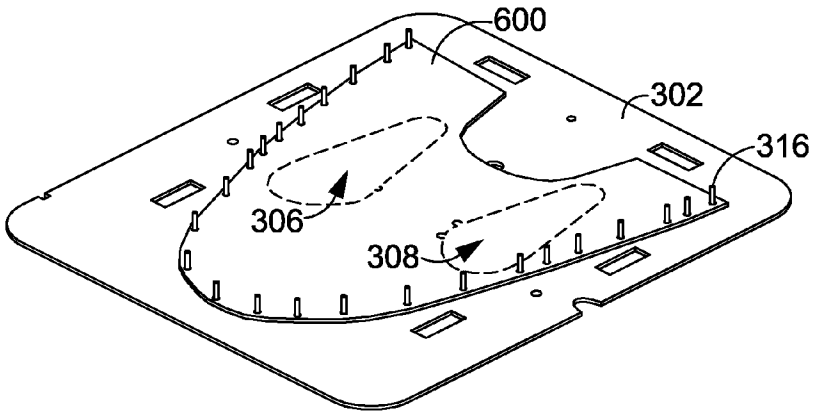
FIG. 6A depicts a maintaining jig having an article secured thereon in accordance with an aspect hereof.

The processing apertures 304, 306, 308 extend from the bottom surface through the top surface of the first maintaining jig 302. The process apertures allow for a direct application of steam through the first maintaining jig 302 to a surface of a maintained article thereon. For example, steam may be applied from one or more of the top surface and/or the bottom surface of the first maintaining jig 302 toward an article maintained on the first maintaining jig 302 to process the article, such as relaxing or altering the characteristics of the yarns of the article proximate the processing aperture. The relative location of an exemplary processing aperture of a maintaining jig to a maintained article is generally depicted in FIGS. 6A and 6B hereinafter. A processing aperture may be configured in the first maintaining jig 302 at a location for which an article is desired to be processed, such as printed. Prior to printing the article, it may be advantageous to steam the article proximate the location of printing to prepare the surface of the article for printing. As such, the shape and position of one or more of the processing apertures may be coordinated with locations of the to-be maintained article that are intended to be printed or otherwise processed.

Further, it is contemplated that the shape and location of the processing apertures may be determined, in part, based on the geometry of the article when formed. For example, surfaces intended to be relatively flat when finally formed may be steamed to reduce surface dimensionality variations caused by uneven tensions in those areas. For example, a toe portion of a shoe upper, while generally curved in a medial to lateral direction, is desired in some aspects to have a generally uniform dimensionality across that curve. Therefore, the processing aperture 304 may be positioned on the first maintaining jig 302 in an area generally configured for maintain a toe portion of a shoe upper. Similarly, it is contemplated that a lateral portion of a shoe upper is desired to have a printed indicia placed thereon, such as a logo or other identifying mark. As such, the processing aperture 308 is positioned and shaped to allow for a steaming operation (or other processing technique) to be applied to a maintained shoe upper on the first maintaining jig 302 in preparation for the printing process. Similarly, a medial portion of a shoe upper may be desired to have a post processing procedure performed. Therefore, a processing aperture 306 is provided.

It is contemplated that a processing step that occurs prior to or after pad printing may occur at a different machine in a different location. The maintaining jig, however, may transfer from operation to operation (e.g., location to location) with the article to be processed. Therefore, once the article is positioned and maintained on the maintaining jig, the maintaining jig serves as a carrier interface to align and secure the article in a variety of processes and machines such that the processes and machines can be standardized for the maintaining jig and not the articles. For example, regardless of a shoe upper size to be printed or otherwise processed, a maintaining jig will include the alignment receptors (e.g., 312, 314) having a consistent size, shape, and relative location that is configured to receive a plurality of standardized protrusions from a base plate, in an exemplary aspect. This standardization offered by the maintaining jig, regardless of the article size or shape to be maintained, improves manufacturing efficiencies by allowing standardized or uniform base plate to be coupled with each machine or process.

The plurality of maintainers 316 are protruding members extending from the top surface of the maintaining jig 302. A maintainer may be a fixed connection member that allows a portion of the article-to-be-processed to be secured, such as along a perimeter of the article and/or at internal locations of the article. A knit article may include one or more formed voids, such as voids between knit stitch loops of the formed article, through which a maintainer may extend, as also shown in FIGS. 6A and 6B. The maintainers may secure and align the article while providing a desired tension across one or more portions of the article. This securing and alignment of the article maintains the article in a generally known location such that the article may be aligned with a print pad by way of positioning the maintaining jig in a fixed position on a base plate that is secured to a pad printing device in a known location.

In addition to the plurality of maintainers 316, it is also contemplated that one or more secondary maintainers may be used to secure the article in a defined location on the maintaining jig. However, the secondary maintainers may be maintainers that could interfere with a printing operation as a result of their location. As such, it is contemplated that the secondary maintainers may be secured to a secondary substrate that is positioned, at select times, at a bottom side of the maintaining jig such that the secondary maintainers extend through the maintaining jig to interact with the article. The secondary maintainers may be used during a processing step before or after printing, such as a steaming operation. The secondary maintainers may extend through the first maintaining jig 302 through secondary apertures, such as a secondary aperture 310. The secondary apertures are holes extending through the first maintaining jig 302 allowing for the secondary maintainer to be insertably positioned through the first maintaining jig 302 and interface with the article being maintained. Following the operation benefiting from the secondary maintainers, they may be removed by separating a carrier substrate on to which the secondary maintainers are affixed from the first maintaining jig 302. Therefore, the first maintaining jig 302 is adapted to include a plurality of secondary maintainers that function like the plurality of maintainer 316, but are removable in bulk from the first maintaining jig 302 to prevent interference with a pad performing a pad printing operation. The secondary apertures are positioned, sized, and shaped to receive and align a particular grouping of secondary maintainers, in an exemplary aspect.

The first support member 402 is a pad printing support member that provides a support surface on which an article may cover to resist the compressive force exerted on the article by a pad for a pad printing machine. The first support member 402 also is effective to fill a void created by the processing aperture 308. Therefore, in an exemplary aspect, it is contemplated that the first support member 402 has a thickness extending between a top surface and a bottom surface that is at least that of the thickness of the first maintaining jig 302. It is also contemplated additionally or in the alternative, that the top surface of first support member 402 is substantially flush with the top surface of the first maintaining jig 302 when maintained in the base plate 200. A substantially uniform offset for both the maintaining jig 302 top surface and the support member 402 top surface from the base plate 200 minimizes deformation allowed by the article in resistance to the compressive force applied by a pad during a printing operation. In an additional aspect, it is contemplated that the top surface of the first support member 402 extends above the top surface of the first maintaining jig 302 to introduce an additional tension across the article for purposes of performing the printing operation.

The first support member 402 is comprised of one or more alignment pins 404, 406 extending from the bottom surface. The alignment pins have a cross section shape and size configured to be received by the plurality of receiving portions of a grid in a base plate, such as the receiving portion 224. A distance extending between the alignment pins may be configured to correspond with a distance between potential receiving portions of a grid in a base plate. As such, the first support member 402 may be aligned relative to the first maintaining jig 302 based on the location of the alignment receptors 312, 314, the alignment protrusion 212, 214, and the alignment pins 404, 406, in an exemplary aspect.

Additionally, it is contemplated that one or more registration guides may be indicated on the top surface of a support member. For example, it is contemplated that a replica of the indicia to be printed on an article is also included, such as by etching or other visual markings, on the top surface of the support member. Therefore, the position of the bench or the pad may be adjusted such that the pad effectively strikes the support member in a location that aligns the transferred ink with the indicia contained on the surface of the support member. Therefore, the base plate and the support member are effective for aligning the pad to properly print on an article to be aligned by the base plate, in an exemplary aspect.

The second maintaining jig 304 is comprised of a plurality of processing apertures, such as a processing aperture 309. The processing aperture 309 has a size and shape. A second support member 403 is provided having alignment pins 405, 407. The second support member 403 has a shape similar to that of the processing aperture 309 and a size that allows the second support member 403 to extend through the processing aperture 309. As a result, the second support member 403 may be positioned in the base plate 200 while the second maintaining jig 304 is positioned and removed from the base plate 200 without interference between the second maintaining jig 304 and the second support member 403, in an exemplary aspect. Stated differently, it is contemplated that a support member may be positioned in a base plate while one or more maintaining jigs are subsequently placed on the base plate with the support member passing through a processing aperture and then having the maintaining jigs removed from the base plate without interfering with the support member.

While specific components and arrangement are depicted in discussed with respect to FIG. 3, it is contemplated that any number, combination, and type of component may be implemented to achieve aspects provided herein.

FIG. 4 depicts a front view of the jig assembly 300 in accordance with aspects hereof. The jig assembly 300 is comprised of the first maintaining jig 302 and the second maintaining jig 304 positioned on a top surface of the base plate 200. The bottom surface of the base plate 200 is in contact with and secured to the bench 112, as previously discussed in FIG. 1. The plurality of maintainers 316 are depicted extending from the top surface of each of the maintaining jigs. While a specific arrangement, size, and shape of components are depicted in FIG. 4, it is contemplated that any combination of arrangement, size, or shape may be implemented.

FIG. 5 depicts an exploded view of the jig assembly from FIGS. 3 and 4, in accordance with aspects hereof. The jig assembly is comprised of the first maintaining jig 302 and the second maintaining jig 304. Further, the base plate 200 and the bench 112 are depicted. The alignment pins 405, 407 of the second support portion 403 are depicted as being configured to be received at a plurality of receiving portions 224 in the base plate 200. The particular receiving portions 224 into which the alignment pins 405, 407 are inserted is dependent on a desired location of the second support portion 403 relative to the maintaining jig 200. Also illustrated are the alignment protrusions 206, 208 to which the maintaining jig 304 is aligned and secured to the base plate 200.

FIGS. 6A and 6B depict the maintaining jig 302 having an article 600 secured thereon in accordance with aspects hereof. As depicted, the plurality of maintainers 316 protrude through and secure the article 600 in a desired location of the maintaining jig 302. Also depicted by hidden dashed lines are the locations of processing apertures 306, 308. Because the process apertures 306, 308 are a void of material positioned in a location covered by the article 600, when a pad printing process is performed on the article 600 in the regions of the process apertures 306, 308, the article 600 may stretch as it is pushed through the process apertures 306, 308 toward a base plate. To limit this stretch caused by a pad compression during a pad printing process, the support members may be positioned in the processing apertures 306, 308 to effectively support the article 600 limiting a deformation of the article 600 during the compressive application of the pad. As depicted in FIG. 6B exemplary pad printed indicia 602, 604 are illustrated for explanation purposes. It is understood that any indicia of any size and in any location may be printed in exemplary aspects.

Figure 7:
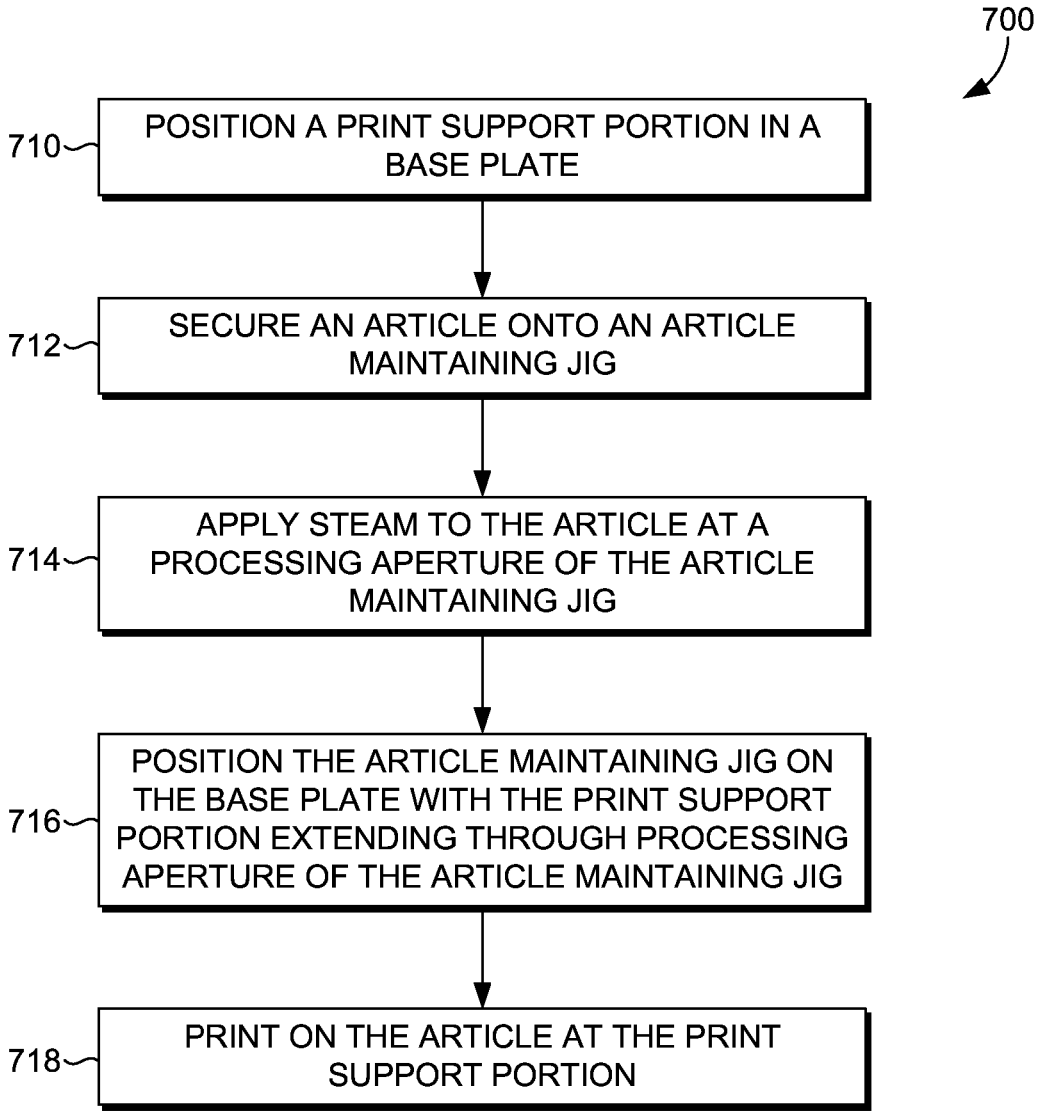
FIG. 7 depicts a diagram representing a method for implementing the printing jig system, in accordance with aspects hereof.

FIG. 7 depicts a flow diagram representing a method 700 for using a printing jig system in accordance with aspects hereof. At a first block 710 a print support portion (e.g., a support member) is positioned in a base plate. As previously provided, one or more alignment pins extending from the bottom surface of the print support portion may be received in one or more receiving portions forming a grid on the base plate. The print support portion is positioned on the base plate in such a manner that a pad printing pad may be aligned to strike in a determined relationship with the print support portion. Further, the print support portion is further aligned in the positioning within the base plate to position the print support portion in a receiving relationship with a maintaining jig that also has a particular alignment with the base plate. Therefore, the print support portion is positioned on the base plate in a manner to allow the print support portion to pass through a processes aperture of the maintaining jig as the maintaining jig is secured and aligned on the base plate.

At a block 712, an article is secured to the maintaining jig. As previously discussed, it is contemplated that the article may be a knit or woven article in an exemplary aspect. Further, it is contemplated that the article may be a knit or woven portion of a shoe, such as a shoe upper portion, in an exemplary aspect. The article may be secured to the maintaining jig in a removable fashion, such as through the use of one or more maintainers extending from a top surface of the maintaining jig, for example. Therefore, the article may be aligned and positioned in a defined relationship to the maintaining jig by positioning one or more of the maintainers in particular location of the article.

At a block 714, which is optional in the recited method 700, steam or heat is applied to the article at a processing aperture of the maintaining jig. For example, it is contemplated that following the securing of the article to the maintaining jig, a steam treatment is applied to the article to process one or more yarns forming the article, such as to equalize tension in individual yarns. The steam treatment may effectively reduce a dimensional variability in the article, which provides a more uniform surface on to which a printing process may be performed.

At a block 716, the maintaining jig is positioned on the base plate. The maintaining jig may be positioned and aligned on the base plate by allowing an alignment protrusion of the base plate to extend through an alignment receptor of the alignment jig. The proper alignment of the maintaining jig on the base plate allows the print support portion to extend through the processing aperture of the maintaining jig. The print support portion therefore supports a bottom side of the article in a plane higher than that of the base plate top surface. It is contemplated, as previously discussed, that the top surface of the print support portion is substantially flush with the top surface of the maintaining jig, in an exemplary aspect.

At a block 718, a printing process, such as pad printing, is performed on the article at a location proximate the under-supporting print support portion. As previously discussed, it is contemplated that the printing by tampography may use a printing pad that transfers a marking agent on a deformable pad. The pad may be compressed against the article a number of times to ensure an effective transfer of ink from the pad to the article.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A printing jig system comprising:

a base plate having a top surface and an opposite bottom surface, a front side and an opposite back side, a first side and an opposite second side, the base plate comprised of:

a plurality of protrusions extending outwardly from the top surface, and a plurality of receiving portions extending from the top surface toward the bottom surface;

an article maintaining jig having a top surface and an opposite bottom surface, a front side and an opposite back side, a first side and an opposite second side, the article maintaining jig comprised of:

a plurality of maintainers extending outwardly from the top surface, a plurality of alignment receptors configured to receive the plurality of protrusions of the base plate such that the bottom surface of the maintaining jig is positionable proximate the top surface of the base plate, and a processing aperture extending from the top surface through the article maintaining jig to the bottom surface; and a print support portion comprised of a top surface and an opposite bottom surface, the print support portion comprised of two or more alignment pins extending outwardly from the bottom surface and adapted to be received in the base plate receiving portions, the print support portion having a shape adapted to pass through the processing aperture of the article maintaining jig.

2. The printing jig system of claim 1, wherein the base plate having a width extending between the first side and the second side that is at least double a width of the article maintaining jig as extending between the first side and the second side of the article maintaining jig.

3. The printing jig system of claim 1, wherein each of the base plate plurality of protrusions are linearly aligned.

4. The printing jig system of claim 1, wherein each of the base plate plurality of protrusions are positioned on the base plate at approximately a midpoint between the base plate front side and back side.

5. The printing jig system of claim 1, wherein the base plate plurality of protrusions are circular in a cross sectional plane parallel to the top surface.

6. The printing jig system of claim 1, wherein a first alignment receptor of the plurality of alignment receptors is circular and has a diameter at least that of one of the base plate plurality of protrusions.

7. The printing jig system of claim 6, wherein a second alignment receptor of the plurality of alignment receptors has a width that is approximate the diameter of one of the base plate plurality of protrusions and a length greater than the diameter of the one base plate protrusion.

8. The printing jig system of claim 1, wherein the base plate plurality of protrusions have a height extending outwardly from the base plate top surface that is less than or equal to the thickness of the article maintaining jig between the top surface and the bottom surface.

9. The printing jig system of claim 1, wherein the plurality of receiving portions are positioned in a grid pattern on the base plate.

10. The printing jig system of claim 1, wherein the plurality of receiving portions have a top surface cross sectional shape adapted to receive the alignment pins.

11. The printing jig system of claim 1, wherein the plurality of receiving portions extend a first depth into the base plate from the top surface, the first depth is greater than or equal to a length the alignment pins extend outwardly from the print support portion bottom surface.

12. The printing jig system of claim 1, wherein a first maintainer of the plurality of maintainers is positioned on a first side of the processing aperture and a second maintainer of the plurality of maintainers is positioned on a second side of the processing aperture allowing an article to be maintained over the processing aperture.

13. The printing jig system of claim 1, wherein the print support portion having a shape of the processing aperture.

14. The printing jig system of claim 1, wherein the print support portion having a thickness between the top surface and the bottom surface that is equal to the thickness of the article maintaining jig between the top surface and the bottom surface.

15. The printing jig system of claim 1, wherein the print support portion having a print alignment indication on the top surface, the print alignment indication identifying a location for a printing operation to occur relative to the maintaining jig.

16. The printing jig system of claim 1, wherein the a first alignment pin and a second alignment pin of the two or more alignment pins are separated by a distance equal to a distance between two of the plurality of receiving portions.

17. A printing jig system comprising:

a base plate having a top surface and an opposite bottom surface, a front side and an opposite back side, a first side and an opposite second side, the base plate comprised of:

a plurality of protrusions extending outwardly from the top surface, the first plurality of protrusion configured to align a maintaining jig, and a plurality of receiving portions extending from the top surface toward the bottom surface, the plurality of receiving portions configured to align a print support portion relative to the maintaining jig;

an article maintaining comprised of:

a plurality of maintainers extending outwardly from the top surface, the plurality of maintainer configured to maintain an article in a defined position relative to the maintaining jig, a plurality of alignment receptors configured to receive the plurality of protrusions of the base plate, and a processing aperture extending through the maintaining jig; and a print support portion comprised of two or more alignment pins configured to be received in the base plate receiving portions, the print support portion having a shape of the processing aperture of the article maintaining jig.

* * * * *